US006168813B1

(12) United States Patent
Blazevich

(10) Patent No.: US 6,168,813 B1
(45) **Date of Patent: *Jan. 2, 2001**

(54) SERVING TRAY WITH SHRIMP

(75) Inventor: John Z. Blazevich, San Pedro, CA (US)

(73) Assignee: Contessa Food Products, San Pedro, CA (US)

( * ) Notice: Under 35 U.S.C. 154(b), the term of this patent shall be extended for 0 days.

This patent is subject to a terminal disclaimer.

(21) Appl. No.: 09/413,613

(22) Filed: Oct. 6, 1999

Related U.S. Application Data

(63) Continuation of application No. 09/243,345, filed on Feb. 1, 1999, now Pat. No. 6,022,571, which is a continuation of application No. 08/939,192, filed on Sep. 29, 1997, now Pat. No. 5,869,120, which is a continuation of application No. 08/551,701, filed on Nov. 1, 1995, now abandoned, which is a continuation of application No. 08/376,053, filed on Jan. 20, 1995, now abandoned, which is a continuation of application No. 08/121,925, filed on Sep. 14, 1993, now abandoned.

(51) Int. Cl.[7] ..... B65D 81/00; B65D 85/00

(52) U.S. Cl. ..... 426/132; 426/106; 426/112; 426/115; 426/120; 426/129

(58) Field of Search ..... 426/112, 115, 426/119, 120, 132, 129, 393, 106; D7/550.1, 551.1, 551.2, 551.3, 553.1–553.8, 554.2, 554.4, 555, 549; 220/574, 575; 62/457.6

(56) References Cited

U.S. PATENT DOCUMENTS

| | | | | |
|---|---|---|---|---|
| D. 87,824 | | 9/1932 | Barnes . | |
| D. 102,968 | * | 1/1937 | Farder | D7/505 |
| D. 105,367 | * | 7/1937 | Swordling | 220/575 |
| D. 221,883 | | 9/1971 | Cash . | |
| D. 237,344 | | 10/1975 | Whitten . | |
| D. 285,638 | | 9/1986 | Trivison . | |
| D. 304,658 | * | 11/1989 | Mattel | D7/552 |
| D. 304,659 | | 11/1989 | Asner . | |
| D. 312,026 | * | 11/1990 | Antoni et al. | D7/552 |
| D. 314,119 | * | 1/1991 | Kauffman | D7/505 |
| D. 328,705 | | 8/1992 | Krupa . | |
| D. 336,216 | * | 6/1993 | Rohrbeck | D7/552 |
| D. 342,646 | * | 12/1993 | Sicard et al. | D7/553 |

(List continued on next page.)

FOREIGN PATENT DOCUMENTS

| | | | | |
|---|---|---|---|---|
| 397802 | * | 3/1909 | (FR) | D7/553 |
| 2622551 | * | 5/1989 | (FR) | 426/124 |
| 8000159 | * | 4/1981 | (NL) | 426/124 |
| 211382 | * | 4/1968 | (SU) | 220/DIG. 6 |

OTHER PUBLICATIONS

Lazy Susan, Harper's Bazaar, Nov. 1947, p. 147.

Steinberg, Rafael, The Cooking of Japan, Foods of the World, Time–Life Books, New York p. 99, 1969.

Hahn, Emily, The Cooking of China, Foods of the World, Time–Life Books, New York, p. 55, 1968.

*Primary Examiner*—Steven Weinstein
(74) *Attorney, Agent, or Firm*—Christie, Parker & Hale, LLP

(57) ABSTRACT

A shrimp tray having a raised, circular, outer rim, a first annular surface extending downwardly from the outer rim toward the center of the tray and a central recessed area. The first annular surface includes a lower portion that defines a plurality of drain holes. The tray is preferably made from a single sheet of material having a uniform thickness. A plurality of shrimp are nested relative to each other on the first annular surface with their tail ends overhanging the circular outer rim of the tray and their forward ends preferably contacting an annular wall. An annular spacer member may be provided to increase the diameter of the tray. Additional annular surfaces may be provided for serving additional layers of shrimp.

14 Claims, 2 Drawing Sheets

U.S. PATENT DOCUMENTS

| | | | | |
|---|---|---|---|---|
| D. 352,204 | | 11/1994 | Hayes et al. . | |
| D. 354,869 | | 1/1995 | Salyer . | |
| D. 356,010 | | 3/1995 | McEntee . | |
| D. 359,418 | | 6/1995 | Sicard et al. . | |
| D. 368,409 | | 4/1996 | Schwartz . | |
| D. 396,606 | | 8/1998 | Blazevich . | |
| D. 401,810 | | 12/1998 | Swift . | |
| D. 404,612 | | 1/1999 | Blazevich . | |
| 947,373 | * | 1/1910 | Coleman | 62/457.6 |
| 1,595,356 | * | 8/1926 | Museman | 220/556 |
| 1,805,287 | * | 5/1931 | Krantz | 220/DIG. 6 |
| 1,949,285 | * | 2/1934 | Porter | 220/506 |
| 2,034,478 | * | 3/1936 | Levy | 62/457.6 |
| 2,732,696 | * | 1/1956 | Baker | 220/DIG. 6 |
| 2,781,651 | | 2/1957 | Cutler . | |
| 3,821,061 | | 6/1974 | Schier . | |
| 4,865,219 | | 9/1989 | Logan et al. . | |
| 4,899,881 | * | 2/1990 | Girard et al. | 426/112 |
| 4,989,419 | * | 2/1991 | Brando et al. | 62/457.6 |
| 4,991,713 | | 2/1991 | Phillips . | |
| 5,139,166 | * | 8/1992 | Smith | D7/505 |

* cited by examiner

SERVING TRAY WITH SHRIMP

This application is a continuation of application Ser. No. 09/243,345, filed Feb. 1, 1999, now U.S. Pat. No. 6,022,571, which is a continuation of application Ser. No. 08/939,192, filed Sep. 29, 1997, now U.S. Pat. No. 5,869,120, which is a continuation of application Ser. No. 08/551,701, filed Nov. 1, 1995, now abandoned, which is a continuation of application Ser. No. 08/376,053 filed Jan. 20, 1995, now abandoned, which is a continuation of application Ser. No. 08/121,925, filed Sep. 14, 1993, now abandoned.

BACKGROUND OF THE INVENTION

This invention relates generally to serving trays and, in particular, to serving trays for shrimp.

Numerous trays are known for serving and presenting food. Although generally satisfactory, such prior art trays are not readily adaptable for serving shrimp and associated condiments, such as cocktail sauce.

Prior to serving shrimp, they are peeled, deveined and cooked. During this process, the inedible tail portion is often left attached to the fleshy edible portion of the shrimp. Such shrimp are referred to as cooked, peeled and deveined tail-on (CPTO). After cooking, the shrimp are then rinsed and served, or frozen for later consumption. One common way of serving shrimp is by chilling them first and then serving them on a serving tray together with a suitable condiment. This procedure causes a problem, however, in that water draining from the shrimp tends to accumulate at the bottom of the serving tray. This can result in spillage when served to a patron or guest. Also, the shrimp are often laid out on the tray in such a manner as to be sitting in the accumulated water, resulting in splashing or dripping onto the patron or guest during consumption.

It should, therefore, be appreciated that there is a need for a tray that is specially adapted for serving and presenting shrimp and associated condiments in an appealing, yet splash-proof, manner.

SUMMARY OF THE INVENTION

The present invention is embodied in a simple, easy to make, serving tray that presents shrimp and condiments in an appealing fashion. The serving tray is specially designed to avoid the accumulation of water that may drain from the shrimp to the bottom of the tray and to prevent water from spilling over the edge of the tray, thus resulting in a less messy presentation to a guest or patron. The shrimp tray of the present invention includes a raised, circular, outer rim having an inner wall and an outer wall connected by an outer ridge. A first annular surface extends downwardly from the outer rim toward the center of the tray. The first annular surface includes a lower portion that defines a plurality of drain holes. A central recessed area is provided for containing a cocktail sauce or other condiment. In a preferred embodiment of the invention, the shrimp serving tray is made from a single sheet of material having a uniform thickness.

One feature of the present invention is the arrangement of the shrimp on the first annular surface. In particular, the shrimp may be nested relative to each other on the first annular surface with their tail ends overhanging the circular outer rim of the tray and their forward ends on the lower portion of the first annular surface. An annular wall inside of and concentric to the circular outer rim may be used to maintain the shrimp in this arrangement.

An additional feature of the present invention is that the tray may define a second annular surface (or more such surfaces) for receiving shrimp. The second annular surface also extends downwardly towards the center of the tray and is interiorly disposed of the first annular surface.

Yet another feature of the invention is an intermediate annular spacer member between the first annular surface and the central recessed area. By increasing the radial width of the annular spacer member, the tray is increased in diameter. This permits more shrimp to be placed on the tray. Additionally, the annular spacer member may serve as a location for placing garnish or as a receptacle for utensils or waste.

Other features and advantages of the present invention should become apparent from the following description of the preferred embodiment, taken in conjunction with the accompanying drawings, which illustrate, by way of example, the principles of the invention.

DETAILED DESCRIPTION OF THE PREFERRED EMBODIMENTS

Figure 1:
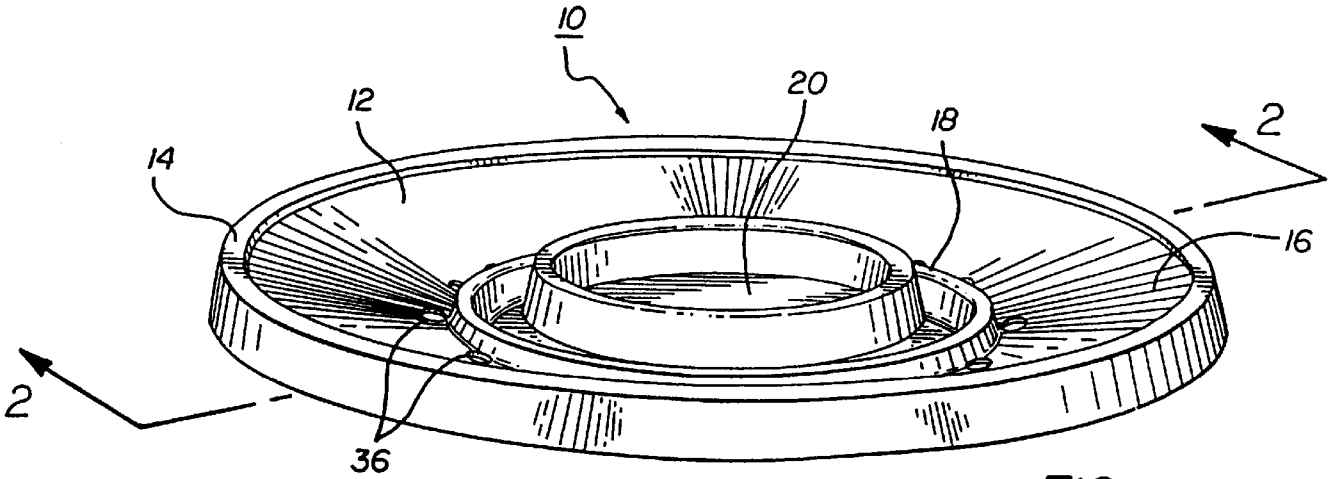
FIG. 1 is a perspective view of a first preferred embodiment of a serving tray embodying the present invention.
Figure 2:
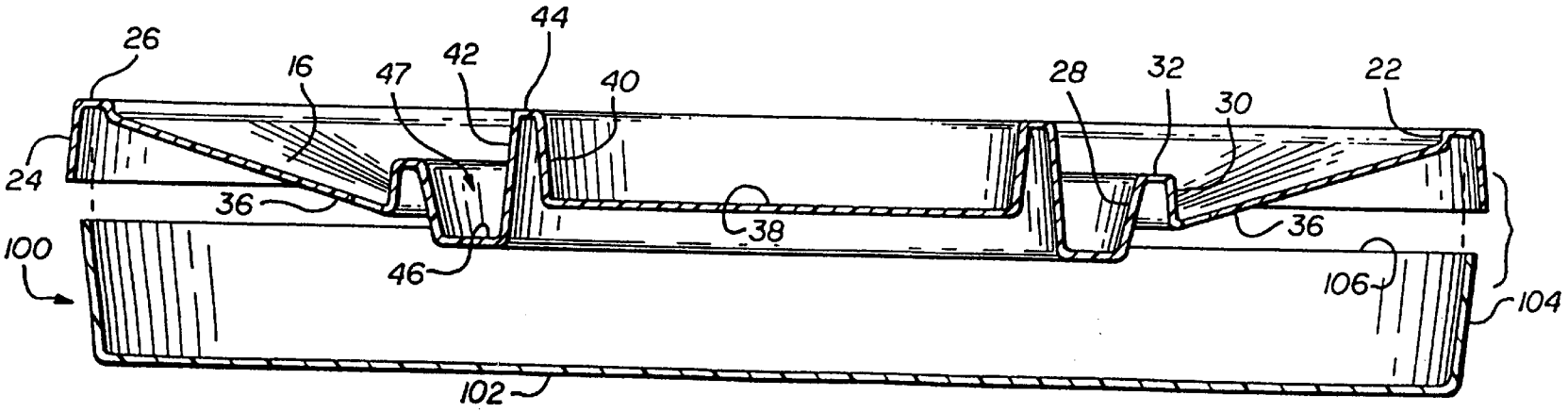
FIG. 2 is a sectional view of the serving tray shown in FIG. 1, taken along line 2—2.

A serving tray 10 embodying the features of the present invention is shown in FIGS. 1 and 2. The tray 10 is preferably made from a single sheet of plastic material 12, and may be made, for example, by thermoforming or vacuforming. The sheet of material 12 defines a raised, circular, outer rim 14, an annular surface 16 extending downwardly and inwardly from the outer rim, an intermediate raised portion 18 disposed inwardly of the annular surface and a central recessed area 20.

The circular outer rim 14 includes an inner wall 22, an outer wall 24 and an outer ridge 26 therebetween. Preferably, the inner and outer walls are vertical or slightly flared. The outer rim assists in preventing accumulated water from spilling over the edge of the tray. The intermediate raised portion 18 similarly includes an inner wall 28 and an outer wall 30. An intermediate ridge 32 connects the inner and outer walls of the intermediate raised portion. Preferably, the inner and outer walls are vertical or slightly flared.

The annular surface 16 has a frustoconical shape that is disposed between the outer wall 30 of the intermediate raised portion and the inner wall 22 of the outer rim. The frustoconical shape ensures that water will drain towards the center of the tray. The width of the annular surface, in a radial direction, is chosen to correspond to the size of the shrimp to be placed on the tray as will be described in further detail in connection with FIGS. 3 and 4. The lower portion of the annular surface, adjacent the outer wall 30 of the intermediate raised portion is provided with a plurality of drain holes 36 to provide drainage for shrimp placed on the annular surface of the tray.

The central recessed area 20 includes a circular base 38, an inner wall 40 extending upwardly from the outer periphery of the circular base and an outer wall 42. An inner ridge 44 connects the inner and outer walls of the central recessed area. Preferably, the central recessed area serves as a receptacle for condiments, such as a cocktail sauce.

Between the lower portion of the outer wall 42 of the central recessed area and the lower portion of the inner wall 28, of the intermediate raised portion is a flat spacer member 46. In the preferred embodiment, the spacer member is disposed at the lowermost portion of the tray to serve as a support. The width of the spacer member, in the radial direction, may be selected to increase the diameter of the tray as a whole, it being appreciated that the greater the tray diameter, the more shrimp that may be placed on the annular surface of the tray. The spacer member also defines a groove 47 that may serve as a location for placing garnish, making the tray more appealing to the guest or patron. Alternatively, the spacer member may be used as a receptacle for utensils or for unconsumed portions of shrimp or for other waste.

A drip pan 100 having a circular base 102 and peripheral wall 104 may be used to collect the liquid that seeps through the drain holes 36 of the serving tray. In the preferred embodiment, the drip pan has a diameter slightly less than the diameter of the outer wall 24 of the circular outer rim 14. The peripheral wall may also be used to support the serving tray, if desired, by placing an upper edge 106 of the peripheral wall into contact with the outer ridge 26 of the circular outer rim.

Figure 3:
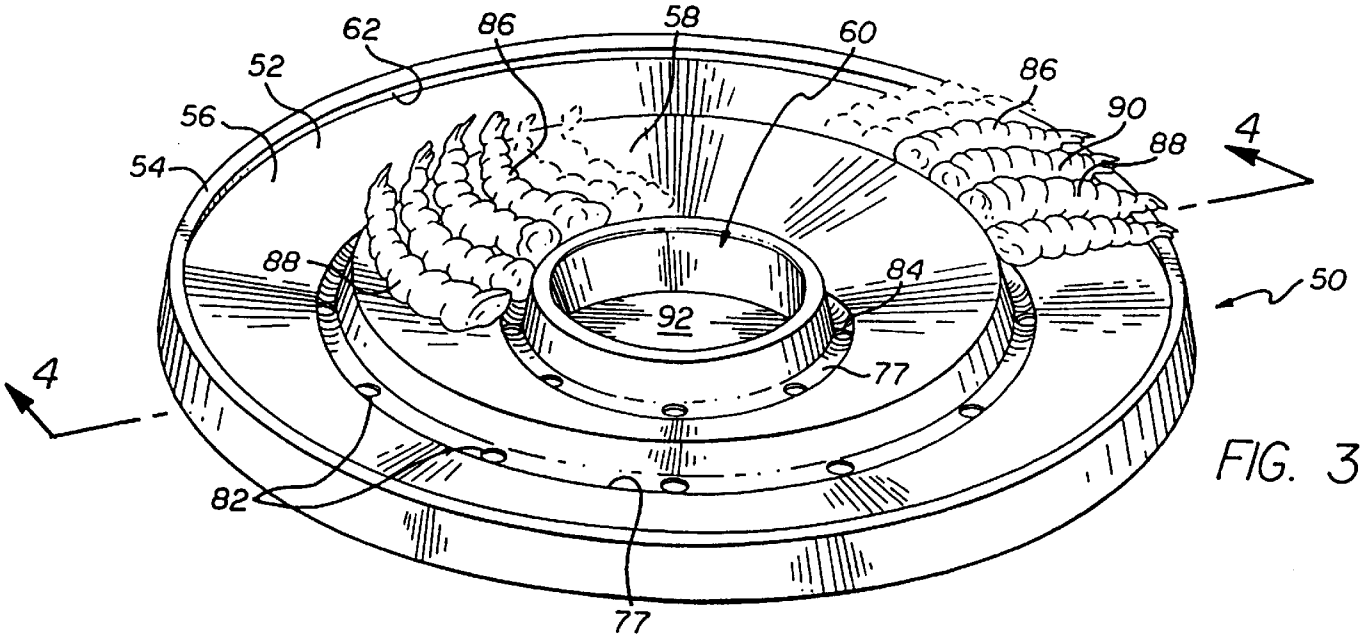
FIG. 3 is a perspective view of a second preferred embodiment of a serving tray embodying the present invention.
Figure 4:
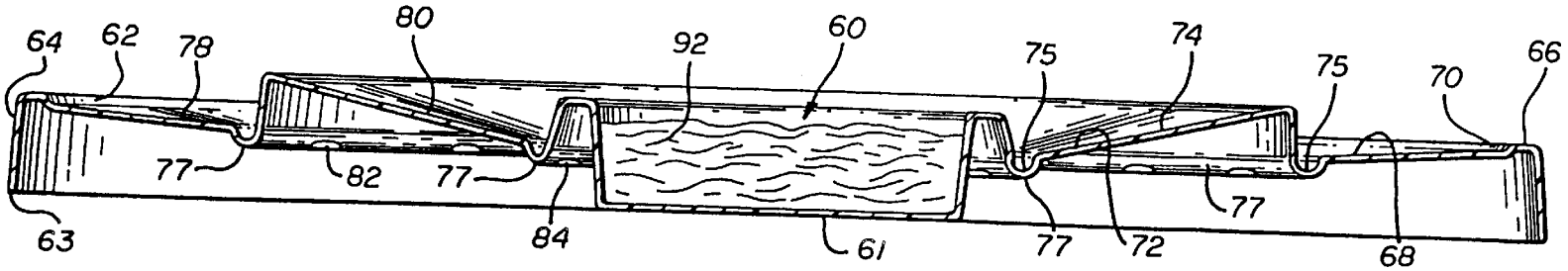
FIG. 4 is a sectional view of the serving tray shown in FIG. 3, taken along line 4—4, with the shrimp omitted.

With reference now to FIGS. 3 and 4, an alternative embodiment of a serving tray 50 according to the present invention will now be described. The tray 50 is also preferably made from a single sheet of material 52. The tray 50 includes a raised, circular, outer rim 54, a first annular surface 56, a second annular surface 58 and a central recesses area 60. The circular outer rim 54 includes an inner wall 62, an outer wall 64 and an outer ridge 66 therebetween. Preferably, the inner and outer walls are vertical or slightly flared. In this embodiment, the central recessed area is constructed in the same manner as shown in FIGS. 1 and 2. In this embodiment, however, a circular base 61 of the central recessed area and a base 63 of the outer wall 64 of the outer rim serve as supports for the tray.

The first annular surface has an inner periphery 68 and outer periphery 70. Similarly, the second annular surface has an inner periphery 72 and an outer periphery 74. An annular wall 76 connects the inner periphery of the first annular surface to the outer periphery of the second annular surface. The first and second annular surfaces are frustoconically shaped and slope inwardly and downwardly. Lower portions 75, 80 of the first and second annular surfaces, respectively, are provided with drain holes, 82, 84, respectively. Instead of or in addition to the drain holes, the lower portions of the annular surfaces may be provided with peripheral grooves 77 for receiving water. In the preferred embodiment, the inner periphery 68 of the first annular surface is below the outer periphery 74 of the second annular surface. A drip pan such as shown in connection with FIGS. 1 and 2 may also be used here.

The widths of the first and second annular surfaces, in the radial direction, are chosen to correspond to the length of each of a plurality of similarly sized shrimp 86, when placed in a preferred orientation on the tray. In particular, the shrimp are laid side by side on the annular surfaces with one shrimp nested into another adjacent shrimp. By the term nested, it is meant to indicate that the shrimp are laid on their sides with a convex outer portion 88 of one shrimp contacting, or in opposed relation to, a concave inner portion 90 of another shrimp. Also, the shrimp are preferably oriented such that the shrimp tails hang over the outer periphery of the annular surfaces, away from any condiment 92 that may be placed in the central recessed area 60. In this orientation, the server is able to present an orderly and appealing arrangement. Additionally, each individual piece may be easily removed from the tray by the guest or patron by grasping the inedible tail portion of the shrimp, thus giving assurance to subsequent partakers that the remaining edible portions of shrimp have not been handled by previous guests or patrons.

If desired, the serving tray shown in FIGS. 3 and 4 may also be provided with a garnish area such as shown at 47 in FIGS. 1 and 2. The garnish area may be placed between the first and second annular surfaces or between the second annular surface and the central recessed area.

It should be appreciated from the foregoing description that the present invention provides a shrimp serving tray that is easy to manufacture, presents a relatively large amount of shrimp in an appealing manner, and avoids the problem of serving shrimp in a tray that has accumulated a pool of water that may splash on guests or patrons during service.

It will, of course, be understood that modifications to the presently preferred embodiment will be apparent to those skilled in the art. For example, the tray may be constructed from multiple sheets of material or from components parts that are connected together. Consequently, the scope of the present invention should not be limited by the particular embodiments discussed above, but should be defined only by the claims set forth below and equivalents thereof.

I claim:

1. A shrimp serving tray, comprising:

an annular surface having an inner periphery and an outer periphery, the inner periphery radially inward of the outer periphery;

an outer rim projecting above and disposed around the outer periphery of the annular surface;

an annular wall projecting upwardly from the inner periphery of the annular surface, wherein the annular surface extends from the annular wall to the outer rim; and a plurality of shrimp that have been cooked tail-on, each one of said plurality of shrimp having a side, a forward end, and a tail;

wherein the plurality of shrimp are circumferentially nested relative to each other, with their sides resting on the annular surface, their forward ends arranged toward the annular wall, and their tails arranged toward the outer rim;

wherein each one of the plurality of shrimp is entirely radially outward of the annular wall and prevented from moving radially inward of the inner periphery of the annular surface by the annular wall;

wherein the width of the annular surface measured radially corresponds to the length of the plurality of shrimp on the tray such that the forward ends rest proximate to the annular wall and the tails rest proximate to the outer rim such that the shrimp may be easily removed from the tray by grasping the tails;

wherein the annular surface has a lower portion relative to the rest of the annular surface to receive drainage from the plurality of shrimp; and wherein the sides of the plurality of shrimp are resting on the annular surface at a location above the lower portion.

2. The shrimp serving tray of claim 1, wherein the tails of the plurality of shrimp contact the outer rim.

3. The shrimp serving tray of claim 1, wherein the forward ends of the plurality of shrimp contact the annular wall.

4. The shrimp serving tray of claim 1, wherein the tails of the plurality of shrimp contact the outer rim and wherein the forward ends of the plurality of shrimp contact the annular wall.

5. The shrimp serving tray of claim 1, wherein the lower portion of the annular surface includes a peripheral groove to receive drainage from the plurality of shrimp.

6. The shrimp serving tray of claim 1, further comprising a central recessed portion inside the annular wall for holding a condiment.

7. The shrimp serving tray of claim 6 wherein the annular surface and the central recessed portion are formed from a single sheet of material.

8. The shrimp serving tray of claim 1, wherein the annular surface is a first annular surface, the annular wall is a first annular wall, and the plurality of shrimp are a first plurality of shrimp and further comprising a second annular surface having an inner periphery and an outer periphery, the second annular surface interiorly disposed of the first annular surface with a second plurality of shrimp resting on the second annular surface and a second annular wall projecting upwardly from the inner periphery of the second annular surface.

9. The shrimp serving tray of claim 8, wherein the first annular wall connects the inner periphery of the first annular surface to the outer periphery of the second annular surface.

10. The shrimp serving tray of claim 9, wherein each one of the second plurality of shrimp has a side, a forward end and a tail, and the second plurality of shrimp are circumferentially nested relative to each other, with their sides resting on the second annular surface, their forward ends arranged toward and proximate to the second annular wall, and their tails overhanging the first annular wall, and wherein each one of the second plurality of shrimp is entirely radially outward of the second annular wall and prevented from moving radially inward of the inner periphery of the second annular surface by the second annular wall.

11. The shrimp serving tray of claim 10, further comprising a central recessed portion inside the second annular wall for holding a condiment.

12. The shrimp serving tray of claim 11 wherein the first and second annular surfaces and the central recessed portion are formed from a single sheet of material.

13. The shrimp serving tray of claim 1, wherein the outer rim includes an inner wall and an outer wall connected by an outer ridge.

14. The shrimp serving tray of claim 1, wherein the lower portion of the annular surface includes a groove to receive drainage from the plurality of shrimp.

* * * * *